US010583350B2

(12) United States Patent
Lam

(10) Patent No.: US 10,583,350 B2
(45) Date of Patent: Mar. 10, 2020

(54) SHOOTING APPARATUS

(71) Applicant: Anthony Lam, Montreal (CA)

(72) Inventor: Anthony Lam, Montreal (CA)

( * ) Notice: Subject to any disclaimer, the term of this patent is extended or adjusted under 35 U.S.C. 154(b) by 533 days.

(21) Appl. No.: 14/973,731

(22) Filed: Dec. 18, 2015

(65) Prior Publication Data

US 2017/0173432 A1 Jun. 22, 2017

(51) Int. Cl.

| | |
|---|---|
| ***A63F 7/06*** | (2006.01) |
| ***A63D 3/02*** | (2006.01) |
| ***A63F 7/24*** | (2006.01) |
| ***A63H 3/14*** | (2006.01) |
| *A63F 7/36* | (2006.01) |
| *A63F 3/00* | (2006.01) |

(52) U.S. Cl.

CPC ..... *A63F 7/06* (2013.01); *A63D 3/02* (2013.01); *A63F 7/0632* (2013.01); *A63F 7/0636* (2013.01); *A63F 7/0668* (2013.01); *A63F 7/0684* (2013.01); *A63F 7/2436* (2013.01); *A63H 3/14* (2013.01); *A63F 2003/00662* (2013.01); *A63F 2007/3681* (2013.01); *A63F 2250/48* (2013.01)

(58) Field of Classification Search

None

See application file for complete search history.

(56) References Cited

U.S. PATENT DOCUMENTS

| | | | | |
|---|---|---|---|---|
| 2,964,320 | A * | 12/1960 | Lebrun | A63F 7/068 273/108.53 |
| 3,785,648 | A * | 1/1974 | Kobayashi | A63F 7/068 273/108.51 |
| 4,007,932 | A * | 2/1977 | LeBrun | A63F 7/0684 273/108.51 |
| 4,076,242 | A * | 2/1978 | Joseph | A63F 7/0684 273/108.51 |
| 5,275,401 | A * | 1/1994 | Llorens | A63F 7/068 273/108.51 |
| 6,220,865 | B1 * | 4/2001 | Macri | A63B 69/00 434/247 |
| 6,478,299 | B2 * | 11/2002 | Bialler | A63F 7/0684 273/108.1 |
| 6,796,914 | B2 * | 9/2004 | Berdugo | A63B 69/002 273/359 |
| 6,796,915 | B2 * | 9/2004 | Getchell | A63B 69/0024 473/438 |

* cited by examiner

*Primary Examiner* — Sunit Pandya

(57) ABSTRACT

A small scale dynamic activity which comprises the use of a method, a hand-operated apparatus, a shooting apparatus, and a playing surface platform, presented as a preferred embodiment in the format of a small scale adaptation of the sport of hockey. A hand-operated apparatus is used as goalie equipment with a method of defending a goal from forthcoming small pucks. A shooting apparatus allows rotating a paddle member to control and propel such small pucks. A playing surface platform complements the use of the method along with these two apparatuses within shielded boundaries. The hand-operated apparatus can be positioned in a pose representative of goalie equipments and of bending of limbs. Furthermore, the present invention can be composed of different arrangements for alternative embodiments such as new types of games or to allow small scale adaptation of a physical activity.

5 Claims, 9 Drawing Sheets

SHOOTING APPARATUS

CROSS-REFERENCE TO RELATED APPLICATIONS

This application is a divisional of U.S. application Ser. No. 13/814,943, filed on Feb. 8, 2013, which is the National Stage of International Application No. PCT/IB2011/053538, filed on Aug. 8, 2011, which claims the benefit of U.S. Provisional Patent Application No. 61/371,724, filed on Aug. 8, 2010.

FIELD OF THE INVENTION

This invention relates to small scale dynamic activities such as pinball, billiards, and bowling. This invention also pertains to adaptations of physical activities such as mini hockey, rod hockey, table soccer, or air hockey. More specifically, the invention provides a more controllable and dynamic way to play such adaptations involving a player propelling a small ball or puck into the opponent's goal while another player protects that goal. This invention also relates to the use of dexterity with a hand equipment in diverse dynamic activities to defend or catch objects such as baseball catchers, hockey blockers or catchers, and recreational catch-ball paddles with hook-and-loop fasteners. Furthermore, this invention presents an apparatus which relates to playing or posing puppets and doll figures.

BACKGROUND OF THE INVENTION

Originally, conventional table hockey such as rod hockey and table soccer such as foosball allowed a rotary member's handle attached to the game platform to simultaneously rotate a small paddle to pass, block, or shoot a ball or puck. Limitations in the movements of the paddle were reduced to only rotate, push-in, and push-out at a linear and static fashion. As a result, this lack of ability to raise the rotary member's handle prevented the possibility to accurately and comfortably lift the ball or puck into the goal. Moreover, the goalie is limited to left or right movements whereas the original sport's goalie can lie down to block lower shots, stand up to block higher shot, raise the arm to catch, and move the legs in different direction or spread them apart. Hence, the miniaturized goalie simulates in limited ways the original sport and lacks in many possible game scenarios such as the possibility of a goal scored between the goalie's legs.

Another variation is the game of air-hockey where the user is allowed more flexibility to move the mallet freely on a surface in order to hit or block the puck. However, the game is often limited to two players and the experience remains two-dimensional because the puck remains at surface level.

Yet another variation of a smaller scale version of hockey takes place on household floors with small hockey sticks and goals where a player can stand up, sit, or kneel down. This mini hockey game also known as knee hockey is limited by the often lack of indoor space obligating the use of a smaller goal too often maladapted to the larger body of the player. The small stick frequently requires turning the shoulders around and moving the arms inconveniently as a result of its limited length. Moreover, the short stick is unable to use the effect of a lever favorably and is thus disadvantageous to attain accuracy and swiftness while performing wrist or slap shots. An often objectionable and inadequate playfield which lacks the presence of a shield results in the ball or puck to repetitively fly away from the dedicated area.

Hand apparatuses used with dexterity to block or catch a ball or puck are recognized and widely used in sports such as baseball using gloves, or hockey using blockers and catchers. Another type features a catch-ball paddle with straps for hand insertion and using hook-and-loop fasteners in order to receive a thrown ball which is also wrapped with hook-and-loop fasteners. Since all of these types only function by grabbing or closing the gap between two edges, and blocking, or fastening by moving a solid item, they do not require the specific use of many different fingers. Hence, those variations of hand equipments hardly benefit from the use of diverse fingers and are limited in additional functions.

SUMMARY OF THE INVENTION

The object of the present invention is to provide a small scale dynamic activity requiring the use of a hand-operated apparatus which can be optionally used with a goaltending method, a shooting apparatus and a playing surface platform. The preferred embodiment of the present invention consists of a small scale adaptation of the sport of hockey to simulate basic dynamic elements with ways to represent its equipments.

The hand-operated apparatus has two main optional features which can be combined or separated. First, this hand-operated apparatus can be used as a finger-operated apparatus with its finger holders. Second, this hand-operated apparatus can also be used with at least one grip member. The preferred embodiment is used as a goalie equipment for the hand which is adapted to represent hockey goalie equipments adopting both the finger-operated apparatus and the grip member. It provides a flexible and ergonomic way to play with small goals within a small area. This preferred embodiment has elongated members representative of pad equipments which simulate movements such as lying down or spreading of legs, and represent the overall look of a real hockey goalie with realistic movements and poses. Additionally, while using the hand-operated apparatus to block a shot, hook-and-loop fasteners add the ability for a small component shaped as a goalie's catcher to fasten to a small puck wrapped with miniature nylon loops.

The goaltending method allows defending a goal or a target and blocking forthcoming objects with specific movements of one hand, using the arm and the wrist as a directional guide for the hand and using the fingers to move lower portion. The finger-operated apparatus can be adapted for use with the goaltending method which provides enhanced control to the movements of the elongated members.

The preferred embodiment of a shooting apparatus provides a way to simulate the use of a hockey stick at a reduced scale, using an arrangement of multiple members angled with the addition of a small hockey paddle, while maintaining most of a regular hockey stick's features and intuitive effectiveness. One advantage is approached by raising the shooting apparatus with one hand with the user's wrist movement, turning a rotary member's handle to allow a paddle of a propeller member to elevate the small puck with precision, while the other hand may hold a support member's handle. As a result, it reduces the necessity to turn the body and move the arms around, thus, allowing the activity to be engaged in tight playing areas. The length of the apparatus allows the possibility of a long reach to enhance control, perform the effect of a lever, and simulate a feeling of a real hockey stick. The shooting apparatus is moveable on multiple axes to slide and turn the paddle in multiple directions to simulate a hockey player's action movements such as stick handling, wrist shots, slap shots, backhand shots, blocked shots, and deflected shots.

The preferred embodiment of this dynamic activity involves propelling a small puck into a goal at one end and blocking such small puck from entering a goal at the other end. The preferred embodiment of the playing surface platform is provided to allow up to six players to simultaneously utilize those apparatuses in order to perform within designated boundaries. Furthermore, the present invention can be composed of different arrangements for alternative embodiments such as new types of activities or to allow realistic adaptation of another game or physical activity such as hockey or soccer. Supplementary portrayal of this new form of dynamic activity will become more explanatory from consideration of the drawings and the following description.

DESCRIPTION OF THE PREFERRED EMBODIMENTS

Figure 1:
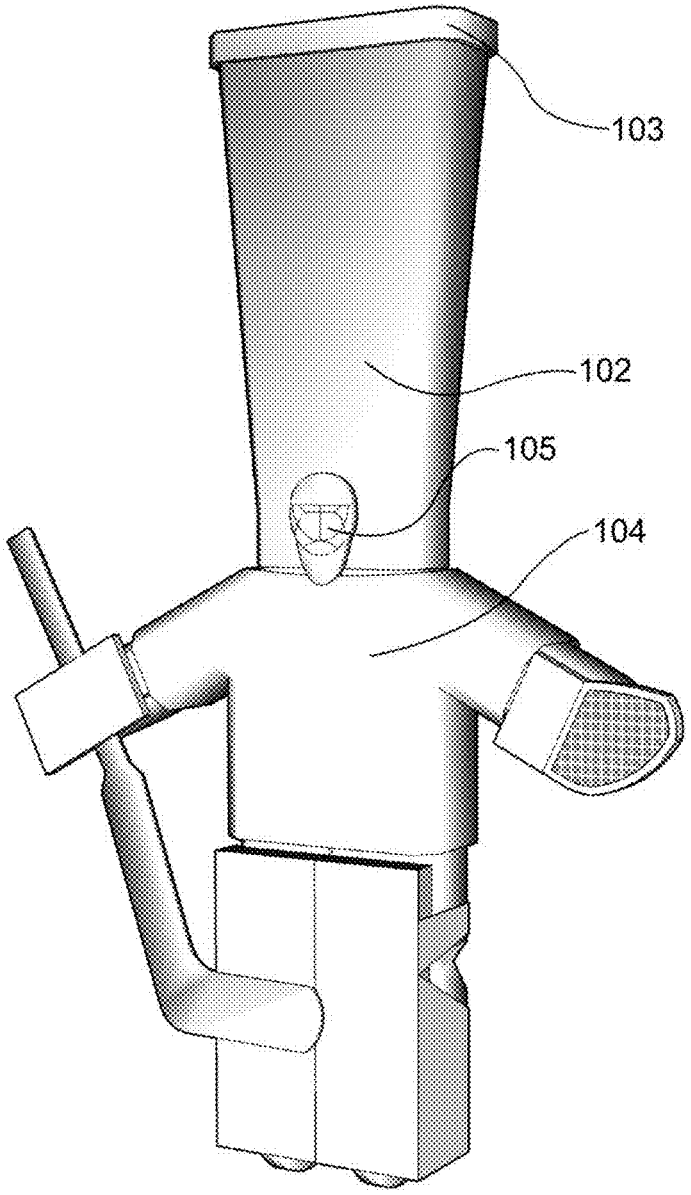
FIG. 1 is a perspective view of a preferred embodiment of a hand-operated apparatus.

FIG. 1 shows a perspective view of a preferred embodiment of a hand-operated apparatus adapted to represent basic hockey goalie equipments. It is composed of a tubular sleeve 102, which is preferably made of nylon material. The tubular sleeve is extended upwards from the hand-operated apparatus and has an embedded metal loop 103 at a main opening perimeter. A housing 104 made of nylon fabric representing a jersey is covering the middle portion of the hand-operated apparatus of FIG. 1. A plastic piece with the shape of a goalie's mask 105 is mounted to the hand-operated apparatus.

Figure 2:
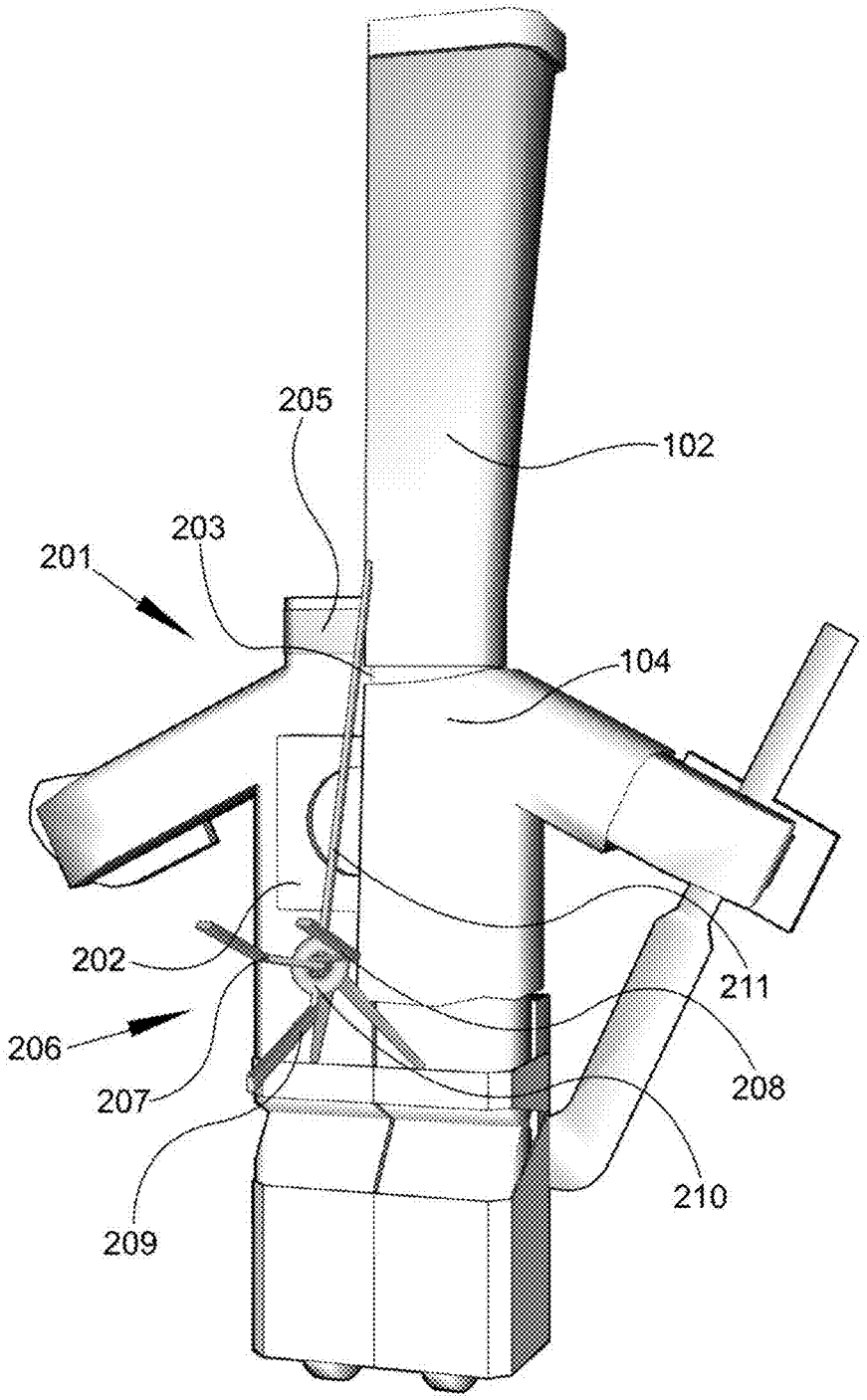
FIG. 2 is a rear sectional view of the preferred embodiment of the hand-operated apparatus, showing some internal components.

FIG. 2 shows a rear sectional view of the hand-operated apparatus illustrated in FIG. 1 with the tubular sleeve 102 and the housing 104 cut in half. A blower fan 202 and its cable 203 are mounted behind the finger holders' framework 201. The opening perimeter of the finger holders' framework 201 is tightened around the edges with the added elastic 205. A grip member 206, entirely made of metal, has a handle composed of a left stick 207, a right stick 208, and a bottom stick 209. The left and right sticks are shaped to reach one another and are jointly overlapped in the center with a conventional rivet. The left stick then bends to the left while the right stick bends to the right side. Their two elongated ends are fastened to the lower portion of the finger holders' framework 201. The bottom stick 209 is welded to a ring 210 which encircles the overlapping sticks. A higher stick 211, also welded to the ring, is elongated and attached to the tubular sleeve 102.

Figure 3:
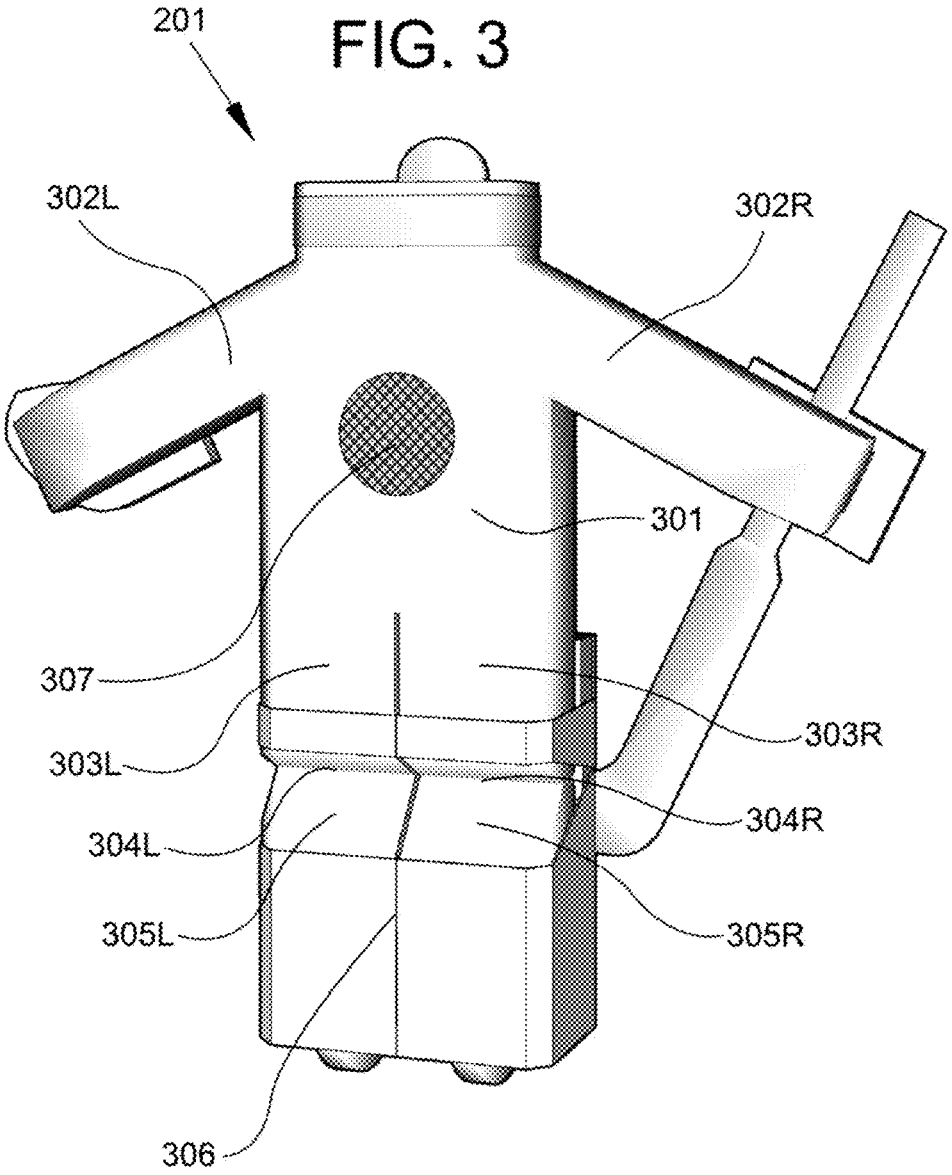
FIG. 3 is a rear sectional view of the preferred embodiment of the hand-operated apparatus with fewer parts.

FIG. 3 shows a rear sectional view of the hand-operated apparatus illustrated in FIG. 1 without the tubular sleeve 102, the blower fan 203, the housing 104, nor the grip member 206. This preferred embodiment has a finger holders' framework 201 consisting of a pouch which has an opening at the top and divides from a central sheath 301 into four finger holders' sheaths; a left side sheath 302L, a right side sheath 302R, and two bottom sheaths 303L and 303R. Two bending lines 304L and 304R are designated preferably by a sewing line for both finger holders' bottom sheaths. The two bottom sheaths represent directional members for its two elongated members 305L and 305R below their bending lines. The left bottom sheath and left elongated member are separated from the right bottom sheath and right elongated member by a space 306. This finger holders' framework 201 and its sheaths are made of nylon fabric. The nylon fabric has a large hole where a meshed fabric 307 is attached.

Figure 4:
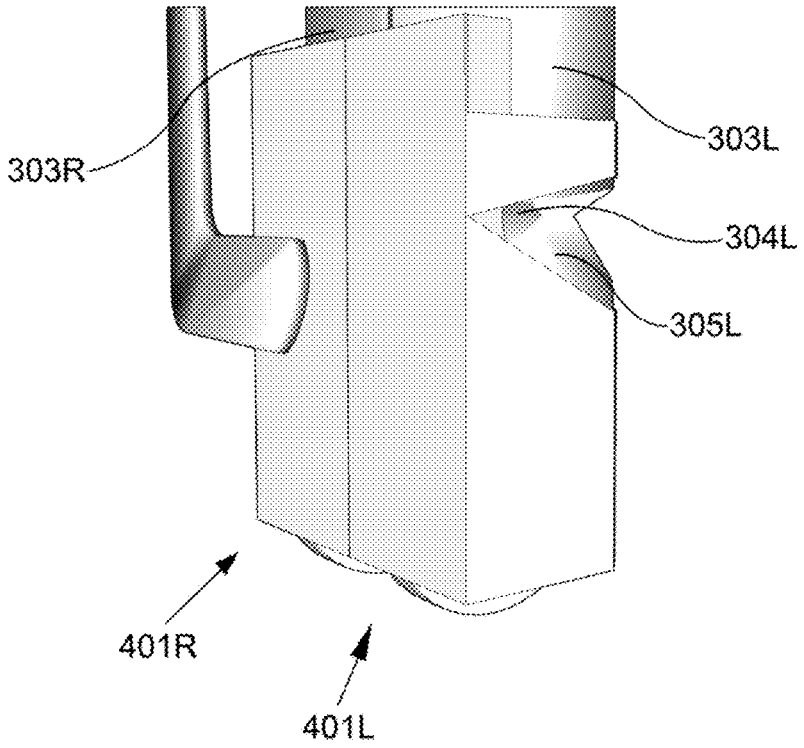
FIG. 4 is a lower perspective view of the preferred embodiment of the hand-operated apparatus.

FIG. 4 shows a perspective view of the finger holders' bottom sheaths 303L and 303R of the hand-operated apparatus illustrated in FIG. 1. The left elongated member 305L is shown extending below the bending line 304L of the left bottom sheath 303L. The left elongated member 305L and the left bottom sheath 303L are wrapped with a small scale representation of goalie pad equipment 401L. The right side components are correspondingly wrapped with pad equipment 401R.

Figure 5:
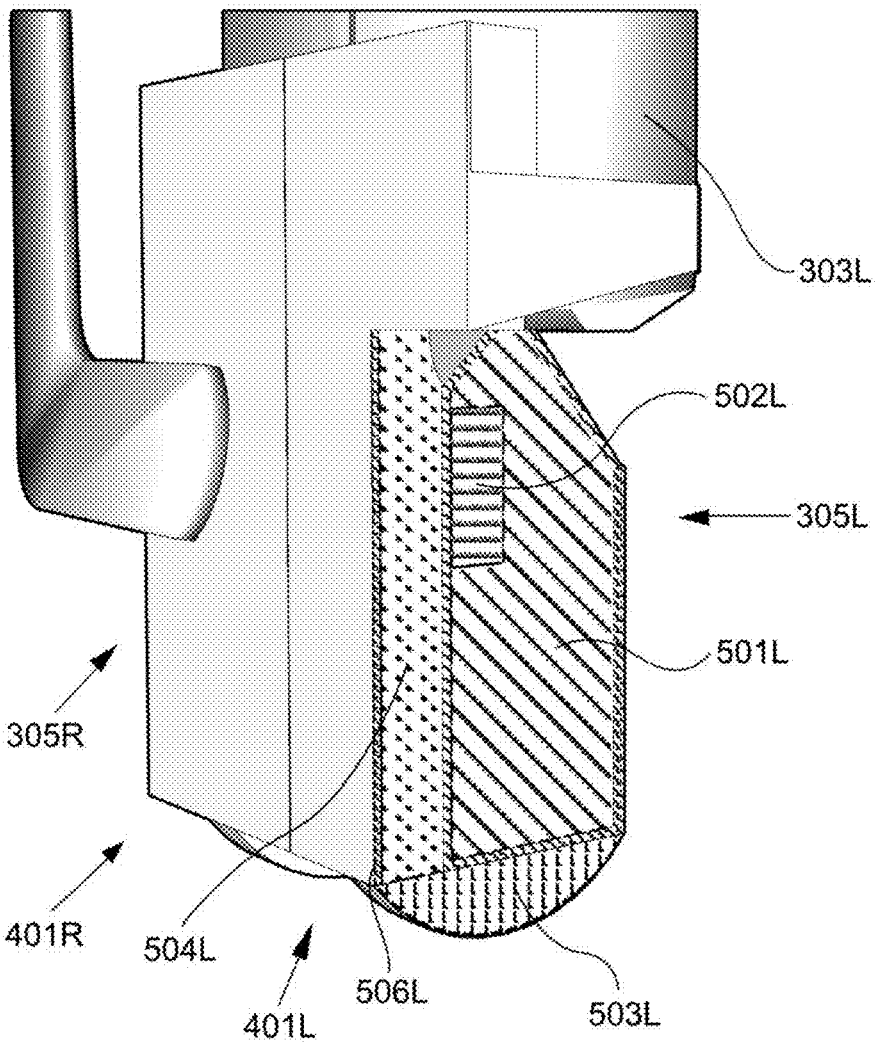
FIG. 5 is a lower partial sectional view of the preferred embodiment of the hand-operated apparatus.

FIG. 5 shows a lower partial sectional view of the left elongated member 305L illustrated in FIG. 4 with a portion cut away to display the internal layers and the left pad equipment 401L. The left elongated member 305L is filled with hardwood material as illustrated in 501L and embedded within with a magnet 502L. A foot 503L made of plastic material is mounted to the hardwood 501L below the elongated member 305L. The right elongated member 305R is correspondingly set the same way using the same components and materials. The left pad equipment 401L have a silicone sheet 504L sewn to the left bottom sheath 303L and left elongated member 305L. Additional layer of leather fabrics 506L is sewn on top and fastened around the left bottom sheaths 303L and left elongated member 305L. The right pad equipment 401R is correspondingly set the same way using the same components and materials.

Figure 6:
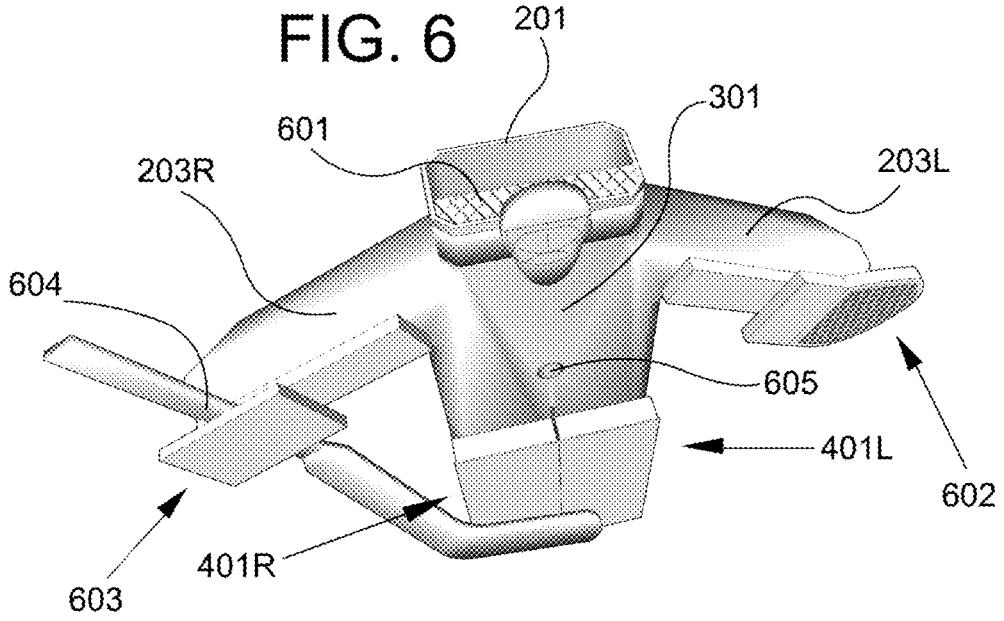
FIG. 6 is a higher perspective view of the preferred embodiment of the hand-operated apparatus.

FIG. 6 shows a higher perspective view of the hand-operated apparatus detailing the left and right finger holders' side sheaths 203L and 203R. A foam layer 601 is fastened to the internal front layer of the finger holders' nylon framework 201. The left side sheath 203L holds a small equipment representative of a goalie's catcher 602. The right side sheath 203R holds a small equipment representative of a goalie's blocker 603. A small equipment representative of a goalie's stick 604 made of thick leather is curved towards the front of the pad equipments 401L and 401R. The central sheath 301 has a front hole 605 embedded in the lower front nylon layer.

Figure 7:
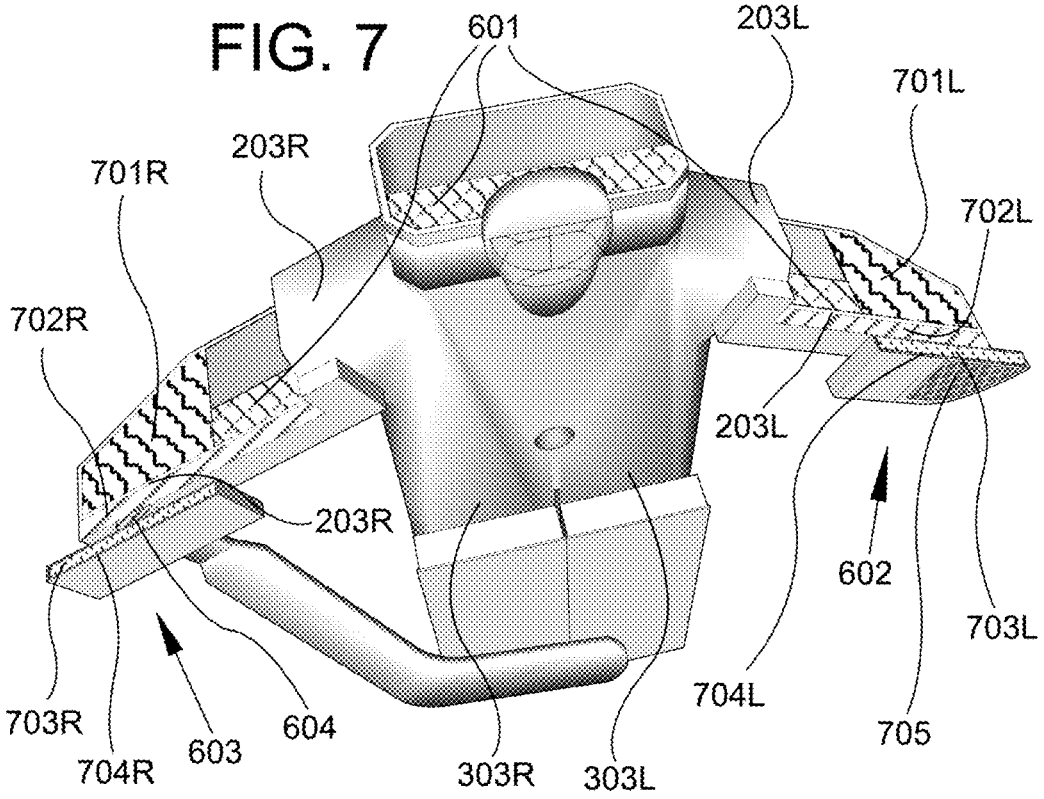
FIG. 7 is a higher partial sectional view of the preferred embodiment of the hand-operated apparatus.

FIG. 7 shows a higher partial sectional view of the hand-operated apparatus illustrated in FIG. 6 to display the inside extremity of the finger holders' side sheaths 203L and 203R with a portion cut away. The left side sheath 203L and right side sheath 203R each contain hardwood material 701L and 701R set within and has a plastic bracket 702L and 702R mounted to the front layer. The catcher 602 is made of plastic sheet 703L with the shape of a catcher's silhouette, and is wrapped with a leather fabric 704L which has a hook-and-loop fastener layer 705 attached to the front. A conventional screw (not shown) is set through the catcher 602, the plastic bracket 703L, left side sheath 203L, and into the hardwood material 701L. The blocker 603 is made of a plastic sheet 703R with the shape of a blocker equipment, and is wrapped with a leather fabric 704R. A conventional screw (not shown) is set through the blocker 603, the goalie stick 604, the plastic sheet 703R, the right side sheath 203R, and into the hardwood material 701R. The same layer of foam 601 is added to the internal front layer from the top of the finger holders' framework 201 to the bottom sheaths 303L and 303R.

Figure 8:
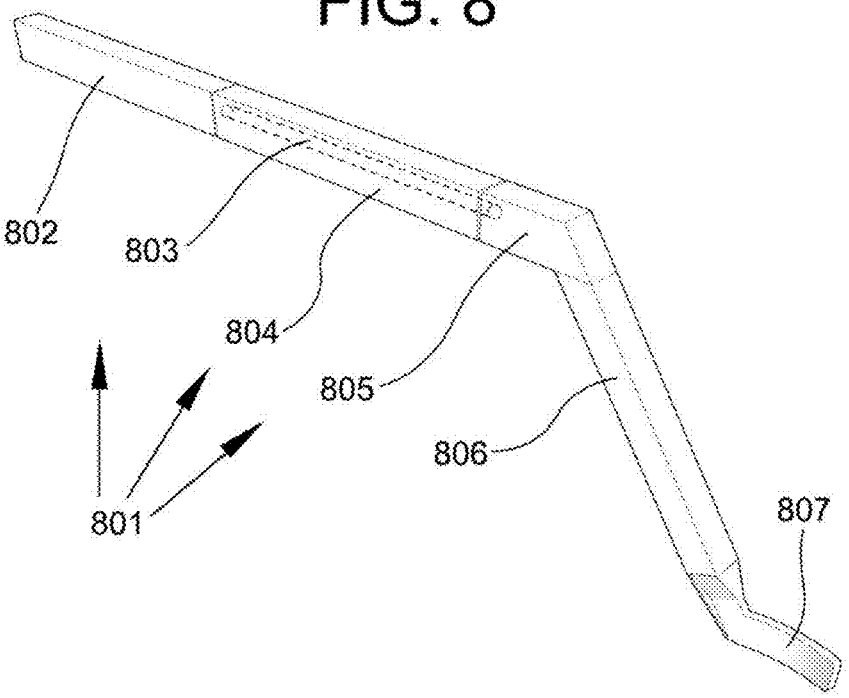
FIG. 8 is a perspective view of a preferred embodiment of a shooting apparatus.

FIG. 8 shows a perspective view of a preferred embodiment of a shooting apparatus which is composed of a rotary member 801 that includes a rotary member's handle 802, a rotary member's shaft 803, and a rotary member's junction block 805. The rotary member's handle 802, preferably made of wood, and is attached to the rotary member's shaft 803 preferably made of a metal rod. The rotary member's shaft 803 goes through a support member's handle 804, preferably made of wood, and is attached to the rotary member's junction block 805 preferably made of wood. The rotary member's junction block is connected to a propeller member 806, preferably made of aluminum, which is attached to the paddle member 807, shaped as a hockey blade, and preferably made of plastic. The propeller member is elongated and angled away from the rotary member's junction block. The paddle member is expanded from the propeller member.

Figure 9:
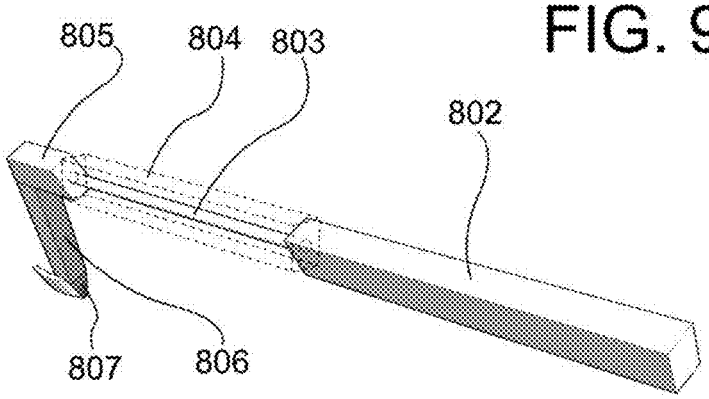
FIG. 9 is a perspective view of the preferred embodiment of the shooting apparatus slightly rotated.

FIG. 9 shows the shooting apparatus of FIG. 8 with the rotary member's handle 802 in a slightly rotated position from the support member 804. The rotary member's shaft 803, rotary member's junction block 805, the propeller member 806, and the paddle member 807 are accompanying the rotary member's handle 802 in its slight rotation.

Figure 12:
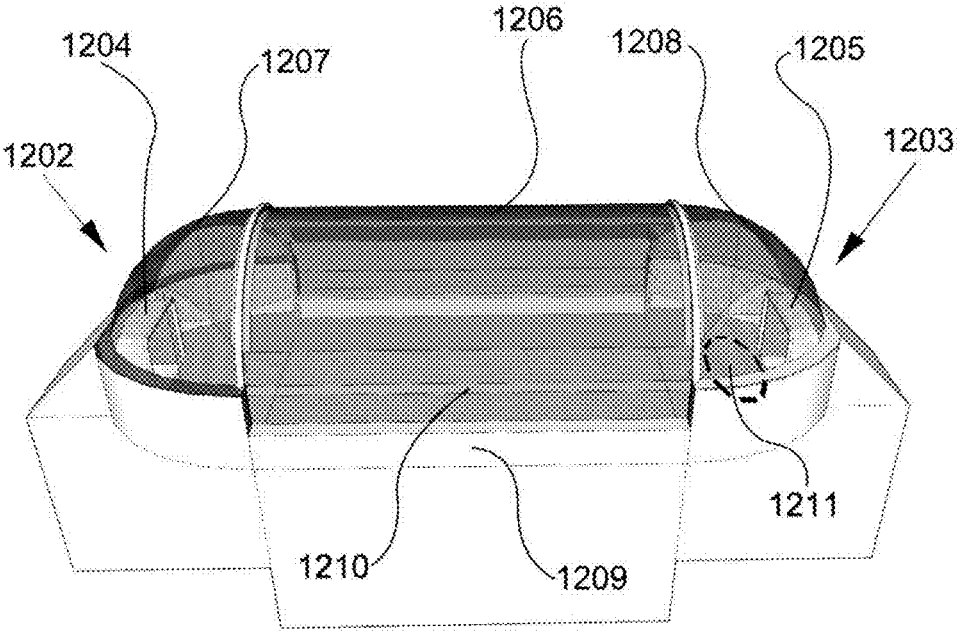
FIG. 12 is a side perspective view of a preferred embodiment of a playing surface platform.

FIG. 12 shows a side perspective view of a preferred embodiment of a playing surface platform which is composed of two identical extremities 1202 and 1203 with their respective goals 1204 and 1205. A central transparent shield 1206, made of plastic material, is mounted to the center of the playing surface platform. Two other transparent shields 1207 and 1208 at each extremity 1202 and 1203, made of plastic material, are mounted to each end of the playing surface platform. A metal shield 1209 is mounted around the playing surface 1210. Twelve magnets 1211 are embedded to the playing surface 1210 below the shield 1208 at one extremity 1202. The same arrangement of magnets is embedded on the playing surface 1210 of the other extremity 1203.

Figure 13:
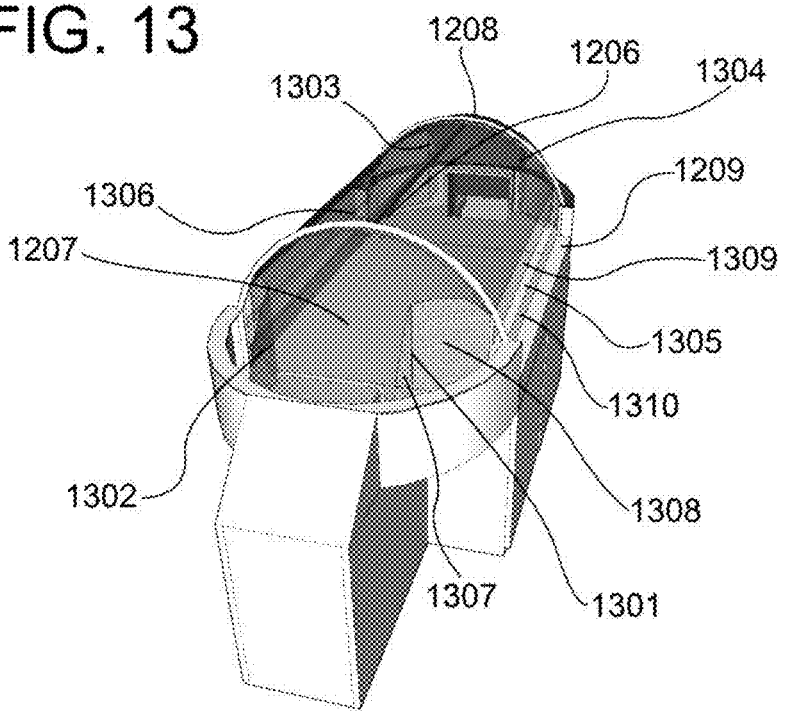
FIG. 13 is a higher perspective view of the preferred embodiment of the playing surface platform.

FIG. 13 shows a higher perspective view of the playing surface platform of FIG. 12 with four dedicated corners 1301, 1302, 1303 and 1304, and two dedicated sides 1305 and 1306. Two corner netting shields 1307 and 1308 are attached to the extremity transparent shield 1207 and are set-up with a corner opening entry 1301 in between. The same setup of corner netting shield is prepared for all four corners 1301, 1302, 1303 and 1304. Higher center netting shield 1309 is attached to the central transparent plastic shield 1206. Lower central netting shield 1310 is attached to the metal boarding shield 1209. The central opening entry 1305 is set up between the higher netting shield 1309 and the lower netting shield 1310. The same setup of central netting shield is prepared on the other side 1306.

The hand-operated apparatus referring to FIG. 1 can be optionally used as a finger-operated apparatus by inserting fingers inside the finger holders' framework 201 or with the grip member 206 of FIG. 2 which is located behind the hand-operated apparatus and grabbed by the fingers. Using the hand-operated apparatus referring to FIG. 3 as a finger-operated apparatus, either a left or a right hand can be inserted in the finger holders' framework 201 with the palm facing forward or backward. The index finger and middle finger are inserted in either of the finger holders' bottom sheaths 303L or 303R and the ring finger and little finger are inserted in the remaining bottom sheath 303L or 303R.

The hand-operated apparatus referring to FIG. 3 used as a finger-operated apparatus allows the left or the right thumb to move either the goalie's catcher 602 or its blocker 603 according to whether the left or right hand of the user is inserted and whether it is facing forward or backward. This arrangement allows the user to achieve different movements to represent the arm movements of a real goalie by inserting the thumb into either finger holders' side sheaths. The left side sheath 302L controls the catcher and the right side sheath 302R controls the blocker. The user can therefore execute the movements to represent respectively a goalie's catcher's catching ability, or his blocker and stick 604 to defend from a small puck or to send it away by smacking on it. The stick 604 can also be used to prevent a shot from entering the space 306 between the finger holders' bottom sheaths 303L and 303R and their elongated members 305L and 305R. The layer of hook-and-loop fastener 705 on the catcher adds the ability to fasten to a small conventional puck, wrapped with miniature nylon loops, while blocking a shot.

Another option for using the hand-operated apparatus referring to FIG. 3 is by grabbing the grip member 206 with one hand which allows defending the goal with the arm and the wrist as directional guides for multiple directional movements to block forthcoming pucks. The grip member allows the hand to grab the left and right sticks 207 and 208. The hand can also hold the ring 210 or the higher stick 211. The grip member can be grabbed from behind, from below, from above, or from the side. It additionally allows the user to slide the fingers between the grip member and the hand-operated apparatus. The grip member is part of the directional members for the elongated members 305L and 305R. Various movements are possible by pushing downwards, upwards, turning sideways, applying pressure to the elongated members and wiggling the catcher 602 and blocker 603 with quick movements of the hand.

The hand-operated apparatus has a lower portion which includes the finger holders' bottom sheaths 303L and 303R representing the thighs, the bending line 304L and 304R representing the knees, and the elongated members 305L and 305R representing the calves. The bottom sheaths 303L and 303R are used as directional members and can bend in multiple directions including towards the front, the sides, and angled between the front and the sides. The bottom sheaths are used to direct the elongated members 305L and 305R which can angle away from the bottom sheaths. The use of the grabbed grip member 206 or the inserted fingers into the finger holders' framework 201 allow controlling the two bottom sheaths 303L and 303R by pushing downward to cause bending and pivoting of the nylon fabric from the bending lines 304L and 304R between the bottom sheaths and their elongated members 305L and 305R. The fingers are part of the directional members for the elongated members which can be directed to widen apart using the hand-operated apparatus as a finger-operated apparatus by spreading the index finger and middle finger away from the ring finger and little finger. Using the grip member 206, the elongated members can also be directed to widen apart by squeezing left and right sticks 207 and 208 together, which allows the center joint rotation to spread their ends and expand the bottom sheaths. As the elongated members 305L and 305R follow, they are pushed downward and can be slightly split apart by pushing downward the directional members represented by the bottom sheaths. As a result of downward pressure from the elongated members against a surface which causes bending, the elongated members become angled towards the back of the hand-operated apparatus. The elongated members can also be turned outwards to the sides, which then form an angle between the back and the sides in order to represent a more accurate look of a real hockey goalie before, during, and after a kneeling down action.

As illustrated in FIG. 5 for the left elongated member, a silicone sheet 504L is used to initiate the release from bending. It is embedded into each pad equipment 401L and 401R in such a fashion as to create tension allowing it to bounce back after the act of bending. This allows the user to be quickly returned to the initial position and be set for more dynamic activity. Additionally, a pose representative of a laid down goalie is attained by placing the hand-operated apparatus of FIG. 1 on a surface, turning the grabbed grip member 206 or pointing the inserted fingers on the side. Many other movements are possible such as sitting, diving, and jumping which are performed by moving the hand-operated apparatus with the wrist and the hand by turning as well as by the pressure applied on a surface to manifest other representations of goalie movements.

When used as a finger-operated apparatus, foam 601 of FIG. 6 is added to the internal front layer of the finger holders' framework 201 for comfort, protection, and to tighten the finger holders' framework to the hand of the user. Similar to a real hockey goalie in a playing position, the hand-operated apparatus has a middle and upper portion including a head, shoulders, a chest, a stomach, a back and a waist which can be bent or angled towards the front using foam adapted for this purpose. The added foam provides additional stiffness to the hand-operated apparatus allowing it to stand and remain flexible while the upper portion is bent towards the front, representing a goalie's pose of forward leaning. This is useful for either the grabbed grip member 206 or the inserted fingers to both allow bending from the middle and upper portion towards the front by using finger movements such as pressing the foam if the fingers are inserted with palm facing the front. Inclining the hand-operated apparatus forward using the grabbed grip member while squeezing with the bottom stick 209 also allows the hand-operated apparatus to angle its upper portion forward from its lower portion. By levering up the bottom stick 209, the ring 210 pivots the higher stick 211 to press on against the tubular sleeve 102. Furthermore, all three sticks allow the hand-operated goalie to pose as a bent down goalie by lightly squeezing the left stick 207, the right stick 208, and the bottom stick 209. As a result, the bottom sheaths and the upper portion would bend towards the front and the elongated members may bend towards the back if pressure is applied. Similarly, the inserted fingers with the palm facing the front may lightly press the hand-operated apparatus to achieve the same result. This allows a pose with parts representative of buttocks pointing to the back and the parts representative of knees and a head pointing to the front. The calves may be slightly or completely bent towards the back similar to a kneeled down goalie in a butterfly style.

As shown in FIG. 5 for the left elongated member 305L of the left finger holder's bottom sheath 303L, a magnet 502L is embedded to allow the user to feel a spontaneous repulsion with the magnetized playing surface 1210 of FIG. 12. It creates a sensation representative of a slippery surface and increases speed to the movements of the hand-operated apparatus. It is embedded identically into both elongated members 305L and 305R. Referring to FIG. 2, the use of a blower fan 202 evacuates the air from the meshed fabric 307 of FIG. 3 of the finger holders' framework 201 to exhaust below the housing 104 and to intake the air from the front hole 605 of FIG. 6. This allows comfort for the hand of the user and durability of the hand-operated apparatus as a result of a thorough air flow circulation to prevent accumulation of humidity.

The method of the present invention pertains to a goaltending method consisting of using with dexterity a wrist, a hand and fingers to block forthcoming objects from hitting a target or entering a goal. This method employs the use of the arm and the wrist as a directional guide to the movements of the fingers. For instance, bending the wrist with the hand on the sides allows sideways movements. This goaltending method also requires the use of multiple fingers by keeping the index finger and middle finger as one member separated from the ring finger and little finger as another member, allowing both members to perform different movements while pointing towards a surface. The separated fingers can also move from the position of pointing towards a surface to the position of pointing in multiple other directions by moving the two members. The thumb can be used to block forthcoming elevated objects. A hand equipment may be used in favor of this goaltending method for protection, aesthetics, and to add more functions, components, or elongated members. The preferred embodiment of the hand-operated apparatus referring to FIG. 1 has been adapted to use this method. Through this goaltending method, the user's reflexes interactively defend the goal 1204 or 1205 on the playing surface platform of FIG. 12 while using all members of the hand-operated apparatus by coordinating movements with fast forthcoming small pucks with dexterity of the fingers including the thumb, the wrist, and the arm. Furthermore, elongated members 305L and 305R from the finger-operated apparatus can be used to apply pressure against a surface in order to cover and defend significant open spaces of the goal. The use of this goaltending method along with the hand-operated goalie allows many possible movements that can be representative of a hockey goalie's poses such as kneeling and spreading of legs.

In operation, the shooting apparatus of FIG. 8 can be raised by the user in order to move on multiple axes and use its members to move on multiple directions. The shooting apparatus is composed of the rotary member 801 used to rotate the propeller member 806. The wrist is used to twist the rotary member's handle 802 by gripping one hand on the support member's handle 804 and the other hand on the rotary member's handle 802. The rotary member's handle can rotate simultaneously with its attached rotary member's shaft 803, rotary member's junction block 805, propeller member 806, and plastic paddle member 807 at its end. As the rotary member's handle revolves the rotary member's shaft 803 through a support member 804 illustrated in FIG.

9, the paddle member's front and back facade move backwards or forwards in a circular motion accordingly in order to slide on and away from the playing surface 1210 of FIG. 12. The propeller member is elongated and angled away from the rotary member's junction block and it is also fastened to the rotary member which allows the circular motion of the paddle member. The paddle member is controlled from the rotary member's handle for sliding in multiple directions with downwards, upwards and sideways movements of the user's hand. The paddle member has the shape of a hockey blade which is expanded from the propeller member, thus, it allows aiming and propelling a small puck with precision from a surface towards an opposite goal 1204 to attempt to score a point against the hand-operated apparatus of FIG. 1. This configuration allows an intuitive feeling of a small puck for smooth movements to represent a wrist shot, slap shot, or backhand shot. Alternatively, the shooting apparatus is also used to pass, deflect a small puck, or defend a goal 1205 from such forthcoming puck.

The playing surface platform of FIGS. 12 and 13 has a set of shields 1206, 1207 and 1208 to prevent small pucks from flying out. The playing surface platform has two extremities 1202 and 1203 each composed of two corner openings 1301, 1302, 1303 and 1304 within respective transparent plastic shield 1207 and 1208 to allow insertion of either a left or a right arm for use with the hand-operated apparatus of FIG. 1 in order to defend their respective goals 1204 and 1205. The goals are dimensioned larger than the hand-operated apparatus. A long central opening entry 1305 is arranged below the central transparent plastic shield 1206 on both sides to allow insertion and operation of the shooting apparatus of FIG. 8. Up to six players can simultaneously participate around the playing surface platform which has a playing surface 1210 at waist level allowing users to sit or stand in order to interactively engage in the dynamic activity.

Up to two players around the playing surface platform may each use the hand-operated apparatus and up to four players may each use the shooting apparatus. Users may use one or two hands to control the shooting apparatus in order to propel a small puck and attempt to score a goal at the opposite extremity. While one hand is inserted into the hand-operated apparatus with the palm facing the front to be used as a finger-operated apparatus, the same hand can be used to grip and control the shooting apparatus of FIG. 8. Using the hand-operated apparatus by grabbing the grip member 206, the player can simultaneously control the shooting apparatus with the other hand. Both apparatuses allow this dynamic activity to involve coordinating with dexterity, moving and shooting with accuracy while incorporating the ability for blocking shots.

The playing surface 1210 of FIG. 12 at the extremity 1202 has a dozen magnets embedded 1211 in order to repulse the hand-operated apparatus of FIG. 1 by the elongated members 305L and 305R to simulate a slippery surface to the hand of the user. The magnets are also embedded into the playing surface 1210 at the other extremity 1203 and function in equivalent fashion.

Other embodiments may be adopted for the present invention, (1) Although in this embodiment referring to FIG. 2 the finger holders' framework 201 of the hand-operated apparatus is used for the side sheaths and bottom sheaths to represent directional members for the fingers which also represent directional members to direct the elongated members 305L and 305R or the blocker 603 and catcher 602, in certain embodiments, directional members may be represented by components embedded inside, below, behind, on top, or in front. It may be connected, fastened, or part of the hand-operated apparatus such as branching to the elongated members. Thus, it may be controlled by the fingers away from the hand-operated apparatus or directly linked to one or a plurality of its part.

(2) Although in this embodiment referring to FIG. 2 the finger holders' framework 201 is used for the side sheaths and bottom sheaths to represent the flexible arms and legs, certain embodiments may be composed of a hinge, a joint, a ball-joint, or other flexible materials such as springs, metals, and rubbers to represent flexible arms and legs.

(3) Although in this embodiment referring to FIG. 1 the hand-operated apparatus is presented with a grip member 206, certain embodiments may be a hand-operated apparatus used as a finger-operated apparatus which may be composed without such grip member.

(4) Although in this embodiment the foam 601 and nylon framework 201 are used to allow the middle and upper portion of the hand-operated apparatus to bend towards the front, in certain embodiments, a hand-operated apparatus may also use flexible or bendable materials such as metals, plastics, fabrics, rubbers, or other parts such as hinges, joints, ball joints, or springs to allow the middle and upper portion to fold, swivel, pivot, or shift angle towards the front. Furthermore, the bending area may be a small line or a large area where multiple bending lines are possible. Middle and upper portions may include parts representing the head, the shoulders, the chest, the back, or the waist.

(5) Although in this embodiment the foam 601 and the nylon framework 201 are used to allow the middle and upper portion of the hand-operated apparatus to release from bending, in certain embodiments the release may also occur using weight or different arrangements of one or a plurality of materials such as springs, rubbers, plastics, or metals. Additional variations may use other ways such as electrical current, magnetism, strings, air, or gears, and may be fixated in a way as to create tension or disproportion, allowing the middle and upper portion to unbend after the act of bending or pivoting. Middle and upper portion may include the parts representing the head, the shoulders, the chest, the back, or the waist.

(6) Although in this embodiment referring to FIG. 1 the hand-operated apparatus pad equipments are straight when unused, certain embodiments may be composed of pad equipments in a slightly bent position when unused. For instance, a hand-operated apparatus may be composed of pad equipments slightly bent and angled to allow a grip member's applied pressure to quickly cause further bending of such pad equipments of such elongated members.

(7) Although in this embodiment referring to FIG. 1 the hand-operated apparatus is straight when unused, certain embodiments may be composed of a hand-operated apparatus in a pose representing a kneeled down goalie when unused. For instance, a hand-operated apparatus may have pad equipments bent at an unused state and unbend whenever activated. For instance, a push of a button, a turning of a knob, a trigger from a switch, the pulling of a wire, or a release of a wire may release such pad equipments from bending.

(8) Although in this embodiment the lower, middle, and upper portions are straight at their initial state when unused as illustrated in FIG. 3, in certain embodiments, the initial state of the lower, middle, or upper portions may be completely bent, slightly bent, or angled to the sides. For instance, when inactive, the elongated member representing the calf and the directional member representing the thigh may be slightly angled while the bending line representing the knee might be slightly bent or completely bent. On the other hand, when inactive, the side sheaths representing the arms, the catcher, and the blocker may be slightly angled, slightly bent, or completely bent.

(9) Although in this embodiment the lower, middle, and upper portions are straight at their initial state when unused as illustrated in FIG. 3, in certain embodiments, when unused, the initial state of the lower, middle, or upper portions may be completely bent, slightly bent, angled to the sides, angled in an area between the front or the back, or remain unbent. When active, the bent parts may unbend while some bent or unbent parts may remain unchanged. For instance, a fixed figure may be used which comprises of bottom sheaths, middle portion and higher portion in a bent or unbent upper portion where elongated parts may be added to bend or pivot when active.

(10) Although in this embodiment referring to FIG. 1 the hand-operated apparatus has a set of parts representative of hockey goalie equipments such as pad equipments 401L and 401R, a catcher 602, a blocker 603, and a mask 105, in certain embodiments, a hand-operated apparatus may be shaped, arranged, or composed of one or a plurality of parts representing different equipments or apparels such as a mask, a helmet, a jersey, a pant, a shield, or a robot figure. Such part may also be two-dimensional using thin materials such as printed graphics or embroidery. Furthermore, parts may also represent a chest protector, a neck protector, a jock strap, hockey pants, or skates.

(11) Although in this embodiment referring to FIG. 3 the hand-operated apparatus is composed of elongated members 305L and 305R, in certain embodiments, a hand-operated apparatus may be shaped, arranged, or composed of one or a plurality of elongated members of different sizes using various materials such as fabrics, papers, woods, plastics, metals, or rubbers.

(12) Although in this embodiment referring to FIG. 3 the elongated members 305L and 305R are in rectangular shapes, in certain embodiments, other shapes and thicknesses are possible such as triangular, spherical, and cylindrical structures.

(13) Although in this embodiment referring to FIG. 3 the two bottom sheaths 303L and 303R representing directional members can cause a bending of lower portion composed of the nylon fabric and silicone through the bending lines 304L and 304R between the bottom sheaths and their elongated members 305L and 305R, in certain embodiments, a hand-operated apparatus may be composed of other parts to cause a bending or pivoting such as hinges, joints, ball joints, or other types of flexible materials such as springs, rubbers, plastics, metals, papers, or fabrics. Such materials may serve the same purpose of folding, bending, pivoting, or shifting angles of such elongated members from such finger holders. Furthermore, the bending or pivoting may occur lower or higher and there may be additional and larger bending or pivoting lines or spots. For instance, using this embodiment with the grip member 206, the bending occurs at the bending line 304L and 304R in addition to slight bending and pivoting of other spots and members such as the central sheath 301 and side sheaths 302L and 302R.

(14) Although in this embodiment the nylon fabric at the bending lines 304L and 304R is released from bending through the release of tension of silicone sheet and nylon fabric, in certain embodiments, the release may also occur using only weight or different arrangements of one or a plurality of materials such as springs, rubbers, plastics, or metals. Additional variations may use other ways such as electrical current, magnetism, strings, air, or gears, and may be fixated in a way as to create tension or disproportion, allowing elongated members to bounce back after the act of bending or pivoting.

(15) Although in this embodiment the nylon fabric at the bending lines 304L and 304R is released from bending through the release of tension of a silicone sheet, nylon fabric, and the weight of the elongated members 305L and 305R, in certain embodiments, a hand-operated apparatus may also be used without tension or without release of tension.

(16) Although in this embodiment each elongated member 305L and 305R have magnetism embedded as illustrated in FIG. 5 for the left elongated member's magnet 502L, in certain embodiments, a single or a plurality of magnets may also be implemented in different arrangement to interact with game elements such as attracting a small ball or puck.

(17) Although in this embodiment referring to FIG. 2 a blower fan 202 is used for the hand-operated apparatus for ventilation, in certain embodiments, other arrangements such as multiple openings or intake fans may be implemented to aerate the hand of the user.

(18) Although in this embodiment referring to FIG. 7 a hook-and-loop fastener 705 has been implemented to the catcher 602 of the hand apparatus, in certain embodiments, it is also possible for a hook-and-loop fastener to be shaped differently and positioned at different locations to fasten with game elements.

(19) Although in this embodiment referring to FIG. 1 the hand-operated apparatus is composed of finger holders' bottom sheaths 303L and 303R representing directional members for the elongated members 305L and 305R, in certain embodiments the hand-operated apparatus may be composed without finger holders where other solid or flexible materials may represent directional members for elongated members. For instance, the grip member may control elongated members via directional members made of thin plastic material or solid wood material. Therefore, the need for bottom sheaths may be optional since the grip member can be used instead of inserted fingers.

(20) Although in this embodiment referring to FIG. 1 the hand-operated apparatus allow the use of fingers to bend the finger holders' bottom sheaths 303L and 303R towards the front, representing directional members for the elongated members 305L and 305R and bending the upper portion towards the front, in certain embodiments the hand-operated apparatus may be composed without finger holders where other solid or flexible materials may represent directional members for elongated members. A mechanism such as a ball jointed stick or a hinge may also be used to simulate movements similar to finger movements. Also, flexible materials may direct the bottom sheaths to bend towards the side, towards the front, or at an angle in between. The upper portion may remain straight or may bend towards the front.

(21) Although in this embodiment referring to FIG. 1 the hand-operated apparatus has bottom sheaths 303L and 303R representing directional members, in certain embodiments, a large area of a hand-operated apparatus may represent a directional member for the elongated members as well. For instance, a grip member may be fastened to any part of the hand-operated apparatus such as the shoulders or may be fastened to a large spot such as the back.

(22) Although in this embodiment referring to FIG. 1 the hand-operated apparatus is presented with a grip member 206 with squeezable handles, in certain embodiments, the grip member may be shaped differently such as a horseshoe, a circle, or a triangle and may be composed of multiple support sticks of different shapes and lengths.

(23) Although in this embodiment referring to FIG. 1 the hand-operated apparatus is presented with a grip member 206 shaped for squeezing by the hand, in certain embodiments, the hand-operated apparatus may be composed of a grip member shaped as an elliptical or customized shape to fit the hand

(24) Although in this embodiment referring to FIG. 1 the hand-operated apparatus is presented with a grip member 206 shaped for squeezing by the hand, in certain embodiments, instead of grabbing the grip member, the hand may also fit between an added grip member and the hand-operated apparatus or through other conceivable components.

(25) Although in this embodiment referring to FIG. 1 the hand-operated apparatus is presented with a grip member 206 shaped for squeezing by one hand, in certain embodiments, the grip member may be composed of a wheel or rounded shape for use with both hands similar to a steering wheel.

(26) Although in this embodiment referring to FIG. 1 the hand-operated apparatus is presented with a grip member 206 representing directional members mounted to the bottom sheaths 303L and 303R which also represent directional members for the elongated members 305L and 305R, in certain embodiments, directional members may also be part of the elongated members or be represented by the elongated members.

(27) Although in this embodiment referring to FIG. 1 the hand-operated apparatus is presented with bottom sheaths 303L and 303R representing directional members as thighs, in certain embodiments, directional members may also be part of calves or be represented by a back, a waist, calves, or feet

(28) Although in this embodiment referring to FIG. 1 the hand-operated apparatus is presented with pad equipments 401L and 401R which are used to wrap the bottom sheaths and the elongated members, in certain embodiments, goalie equipments may also represent directional members which are used to direct elongated parts.

(29) Although in this embodiment referring to FIG. 1 the hand-operated apparatus is presented with bottom sheaths 303L and 303R representing directional members for control using a grip member or specific fingers, in certain embodiments, one or a plurality of directional members may be shaped to serve for at least two elongated members using any part of the body to control elongated members or with adapted mechanical or robotic directional members.

(30) Although in this embodiment referring to FIG. 1 the hand-operated apparatus is presented with bottom sheaths 303L and 303R representing directional members for control using a grip member or specific fingers, in certain embodiments one or a plurality of directional members may be shaped to direct at least two elongated members from above. For instance, a hand-operated apparatus may be suspended to a higher structure allowing elongated members to be controlled by being pushed down or pulled down using weight or pressure.

(31) Although in this embodiment referring to FIG. 1 the hand-operated apparatus is presented with a grip member 206 mounted behind the bottom sheaths 303L and 303R representing directional members, in certain embodiments, the grip member may be mounted anywhere on the hand-operated apparatus using any type of materials such as strings, wires, fabrics, rubbers, metals, plastics or support sticks. Furthermore, there may be one or a plurality of materials such as support sticks shaped differently and elongated from different spots of the hand-operated apparatus and grip member. For instance, a support stick may be fastened to the middle or upper portion of the hand-operated apparatus such as at the arms or the back.

(32) Although in this embodiment referring to FIG. 1 the hand-operated apparatus is presented with a grip member 206 made of solid metal components, in certain embodiments the grip member may be made of other type of materials such as fabrics, rubbers, plastics, or woods. String and wires may also be used.

(33) Although in this embodiment referring to FIG. 1 the hand-operated apparatus is presented with a grip member 206 for grabbing by the hand, certain embodiments may be composed of a grip member shaped for hand insertion or finger insertion. For instance, there may be holes similar to a bowling ball for insertion of fingers or there may be a dedicated space for fingers such as added finger holders.

(34) Although in this embodiment referring to FIG. 1 the hand-operated apparatus is presented with a grip member 206 shaped for squeezing by the hand, certain embodiments may be composed of a grip member with a hole for hand insertion or for holding by the fingers. For instance, the grip member may be composed of a glove or a pouch for insertion of the hand or a grip member shaped as a door handle made of a hard or flexible material.

(35) Although in this embodiment referring to FIG. 1 the hand-operated apparatus is presented with a grip member 206 for grabbing by the hand, certain embodiments may be composed of a grip member that allows the first to be inserted. For instance, there may an attachment for the wrist or it may be strapped to the hand

(36) Although in this embodiment referring to FIG. 1 the hand-operated apparatus is presented with a grip member 206 for grabbing by the hand, certain embodiments may be composed of flexible materials where the hand, the wrist and the arm may be strapped, attached, or adhered.

(37) Although in this embodiment referring to FIG. 1 the hand-operated apparatus is presented with a grip member 206 for use with a single hand, certain embodiments may be composed of multiple grip members for use with two hands. Grip members may be made using strings, wires, sticks, springs, or flexible materials. For instance, there may be two grip members located above or behind the hand-operated apparatus where the user is required to grip both which allows pressing or pulling movements for additional functions.

(38) Although in this embodiment referring to FIG. 1 the hand-operated apparatus is presented with a grip member 206 for use with a single hand, certain embodiments may be composed of two grip members across which can open and close in a cross or scissors-like manner for one or both hands. Such grip members may be located behind or above the hand-operated apparatus to control the elongated members 305L and 305R. Opening and closing such grip members in a cross may cause the elongated members to expand and narrow. Such grip members may also be angled or distorted to reach specific spots or to allow connection with additional mechanical structures or gears.

(39) Although in this embodiment referring to FIG. 1 the hand-operated apparatus is presented with a grip member 206 behind the hand-operated apparatus, certain embodiments may be composed of a grip member located inside the hand-operated apparatus such as inside the finger holders' central sheath 301. For instance, a hand-operated apparatus may not be composed of a finger holders' framework 201, instead, it may be a doll, a small figure, a thin toy figure, or a representation of goalie equipments within which a grip member may be located.

(40) Although in this embodiment referring to FIG. 1 the hand-operated apparatus is presented with a grip member 206 behind the hand-operated apparatus, certain embodiments may be composed of a grip member located beside the hand-operated apparatus. For instance, a grip member may allow the user to grip near the side of the hand-operated apparatus in order to accommodate the use of a playing surface platform.

(41) Although in this embodiment referring to FIG. 1 the hand-operated apparatus is presented with a grip member 206 behind the hand-operated apparatus, certain embodiments may be composed of a grip member located above a hand-operated apparatus. For instance, the grip member may be elongated outward from the middle or upper portion of a hand-operated apparatus. Such elongated grip member may be located straight above, angled behind, or angled to the side of the hand-operated apparatus.

(42) Although in this embodiment referring to FIG. 1 the hand-operated apparatus is presented with a grip member 206 behind the hand-operated apparatus, in certain embodiments the grip member may also be located for a further reach such as angled below the hand-operated apparatus and elongated straight behind outwardly, allowing control from below the surface.

(43) Although in this embodiment referring to FIG. 1 the hand-operated apparatus is presented with a grip member 206 behind the hand-operated apparatus, certain embodiments may be composed of a grip member composed of a mechanical structure below, behind or above the hand-operated apparatus. For instance, one or a plurality of grip members may be fastened to a component or an arrangement of parts for control through swiveling, pivoting, or retention or for the grabbed grip member to apply pressure downward a surface and represent more realistic goalie movements.

(44) Although in this embodiment referring to FIG. 1 the hand-operated apparatus is presented with a single grip member 206 which can be squeezed by the hand, certain embodiments may be composed of a grip member which may swivel or move in circular motion during the control of a hand-operated apparatus.

(45) Although in this embodiment referring to FIG. 1 the hand-operated apparatus is presented with a single grip member 206 which comes straight out from behind the apparatus and is squeezed by the hand, certain embodiments may be composed of a grip member which may be suspended by a support member to control of the hand-operated apparatus. Such support member may be mounted to the surface components or be hand-held.

(46) Although in this embodiment referring to FIG. 1 the hand-operated apparatus is presented with a single grip member 206 which can be squeezed by the hand, certain embodiments may be composed of one or a plurality of grip members allowing the push of a button, turning of a knob, a trigger from a switch, release of a wire, or pulling of a wire to interact with the hand-operated apparatus' members for additional functions. For instance, a grip member may be composed of a push button or a switch which may be pressed or turned to animate the goalie's catcher, goalie's blocker, or to allow the goalie stick to move or propel a puck.

(47) Although in this embodiment the foam 601 and nylon framework 201 are used to allow the middle and upper portion of the hand-operated apparatus to bend towards the front by leaning the grip member forward and pressing with the bottom stick 208, certain embodiments may be composed of one or a plurality of components allowing the middle and upper portion to bend such as a rotation or a turn of a handle, a push of a button, a turn of a knob, a trigger from a switch, a release of a wire, or pulling of a wire to interact with the middle and upper portion.

(48) Although in this embodiment, squeezing the grip member allows directional members represented by the bottom sheaths 303L and 303R to widen apart straight to the sides and slightly bend forward the upper portion of the hand-operated apparatus, in certain embodiments the directional members may be directed straight ahead, straight to the sides with a slight angle, or highly angled between the front and the sides, while still allowing the elongated members to angle towards the back.

(49) Although in this embodiment the hand-operated apparatus allows applied pressure, inclining the grip member 206, squeezing, or moving the fingers to bend the finger holders' framework 201, the foam 601, and the silicone 504L which allows the upper portion to bend towards the front and the elongated members to bend towards the back, in certain embodiments a hand-operated apparatus may also bend, pivot, or lean using a system or a component such as a button, a string, a wire, a hinge, a spring, an electrical component, a switch, an electrical current, magnetism, or a knob in order to cause bending, pivoting, or leaning of the upper portion towards the front or the elongated members towards the back. Thus, pressing the foam using fingers or applying pressure on a playing surface may not be necessary to cause a bending of the upper portion or the elongated members. Furthermore, the initial state of the hand-operated apparatus may be straight or be composed of a bent part, therefore, a mechanism or component may be used either to press the hand-operated apparatus or to release the pressed hand-operated apparatus. Such mechanisms may include the use of electrical components such as motors, servo motors, or solenoids.

(50) Although in this embodiment the hand-operated apparatus allows applied pressure, inclining the grip member 206, squeezing, or moving the fingers to bend the finger holders' framework 201, the foam 601, and the silicone 504L to allow the upper portion to bend towards the front and the elongated members to bend towards the back, in certain embodiments, a mechanism may bend the upper portion towards the front and the elongated members towards the back. Additionally, the elongated members may also separate or pivot its legs to represent a split movement or angled legs to the sides. The bending of the upper portion may be bendable at the waist level, chest level, or shoulder level.

(51) Although in this embodiment the hand-operated apparatus allows moving the upper portion members such as the catcher, the blocker, or the side sheaths by inclining the grip member 206, squeezing, wiggling, or moving the inserted fingers in the finger holders' side sheaths 302L and 302R, in certain embodiments, the use of a solid or flexible material, a mechanism, or electrical components such as a solenoid, a servo motor, magnetism, a string, a wire, a lever, a spring, or a gear may also allow control of such upper portion. For instance, control of the catcher and the blocker may be achieved by pressing, moving, or pulling such component.

(52) Although in this embodiment the hand-operated apparatus allows inclining the grip member 206, squeezing, pushing downward, or wiggling in order to interact with the lower portion including the directional members 303L and 303R, the bending line 304L and 304R, and the elongated members 305L and 305R, certain embodiments may use a system or a component such as a button, a string, a wire, a spring, an electrical components, a switch, an electrical current, magnetism, or a knob in order to cause the directional members and elongated members to pivot, twist, widen apart, or angle away. Such system or component may use a material, a mechanism, or electrical components to allow control of the lower portions. Examples include a solenoid, a servo motor, magnetism, a string, a wire, a lever, a spring, or a gear. For instance, instead of using the grip member to wiggle downward on a surface in order to widen the elongated members, a push of a button or a trigger may allow a mechanism to spread the elongated members apart. Such button or trigger may be located on the hand-operated goalie, on a grip member, or on the playing surface platform. Furthermore, such mechanism or initial state may slightly turn the bottom sheaths inwards in an angle and the elongated members outwards to the sides in order to represent a more accurate look of a real hockey goalie before, during, and after kneeling down.

(53) Although in this embodiment the hand-operated apparatus is used with the fingers inside the different sheaths of the finger holders' framework 201, in certain embodiments, various materials may be used to grip, hold, tighten, or strap on to the user's hand such as rings, hoops, elastics, adhesives, or hook-and-loop fasteners. Furthermore, finger holders may be composed of one or a plurality of members for gripping to the fingers.

(54) Although in this embodiment the hand-operated apparatus is used with the fingers inside the different sheaths of the finger holders' framework 201 including bottom sheaths 303L and 303R which represent directional members for the elongated members 305L and 305R, in certain embodiments, finger holders may be located behind, below, above or away from the hand-operated apparatus. Finger holders may then control the directional members from behind, above or away from the hand-operated apparatus. For instance, the hand-operated apparatus may be of a smaller scale and located below finger holders which may require cables or support members to control the directional members to bend the lower portion with the elongated members pivoting towards the back.

(55) Although in this embodiment referring to FIG. 3 the hand-operated apparatus used as a finger-operated apparatus has the nylon finger holders' framework 201 used as a basic coat for the hand, in certain embodiments, a hand-operated apparatus may also be made using other fabrics such as vinyl or leather and other materials such as papers, woods, plastics, metals, or rubbers.

(56) Although in this embodiment referring to FIG. 1 the hand-operated apparatus used as a finger-operated apparatus is adapted for insertion of the user's hand using the nylon finger sheaths 302L, 302R, 303L and 303R with foam 601, in certain embodiments, a hand-operated apparatus used as a finger-operated apparatus may be composed of other materials such as fabrics, papers, woods, plastics, metals, or rubbers, which may used to grip, hold, tighten, or strap on to the user's hand such as rings, hoops, elastics, adhesives, or hook-and-loop fasteners.

(57) Although in this embodiment referring to FIG. 1 the hand-operated apparatus used as a finger-operated apparatus has a set of parts representative of hockey goalie equipments such as pad equipments 401L and 401R, a catcher 602, a blocker 603, and a mask 105, in certain embodiments, a hand-operated apparatus used as a finger-operated apparatus may be shaped, arranged, or composed of one or a plurality of parts that may not represent any popular forms of goalies nor any popular equipments. It is also conceivable that such part or parts may not represent any living entity, doll figure, or robot figure.

(58) Although in this embodiment referring to FIG. 1 the hand-operated apparatus used as a finger-operated apparatus has a set of parts representative of hockey goalie equipments such as pad equipments 401L and 401R, a catcher 602, a blocker 603, and a mask 105, in certain embodiments, a hand-operated apparatus used as a finger-operated apparatus may be shaped, arranged, or composed of one or a plurality of parts representative of different limbs or members of a figure such as a face, an athlete, a doll figure, a living entity, or a robot figure. Such part may also be partly two-dimensional using thin materials such as printed graphics or embroidery.

(59) Although in this embodiment, the bottom sheaths 303L and 303R representing directional members can widen apart in an angle, straight behind, or straight to the sides using fingers, in certain embodiments the directional members may be limited to be directed straight ahead or straight to the sides while still allowing the elongated members to bend towards the back.

(60) Although the method presented in the specification for this embodiment is used with a small scale adaptation of the sport of hockey, the method may also be used to represent a different game or sport or for a new type of game.

(61) Although the method presented in the specification for this embodiment is used with a hand-operated apparatus referring to FIG. 1, the same method may be used without a hand equipment.

(62) Although the method presented in the specification for in this embodiment is used with a hand-operated apparatus referring to FIG. 1, the same method may be used with a different hand equipment composed of other materials such as other fabrics, papers, woods, plastics, metals or rubbers which may be used to grip, hold, tighten, or strap on to the user's hand such as rings, hoops, elastics, adhesives, or hook-and-loop fasteners.

(63) Although the method presented in the specification for this embodiment is used with the finger holders' framework 201 shaped with the addition of the elongated members 305L and 305R, in certain embodiments, finger holders may be composed of one or a plurality of members for gripping to the fingers without such elongated members. For instance, various materials may be used to grip, hold, tighten, or strap on to the user's hand such as rings, hoops, elastics, adhesives, or hook-and-loop fasteners.

Figure 10:
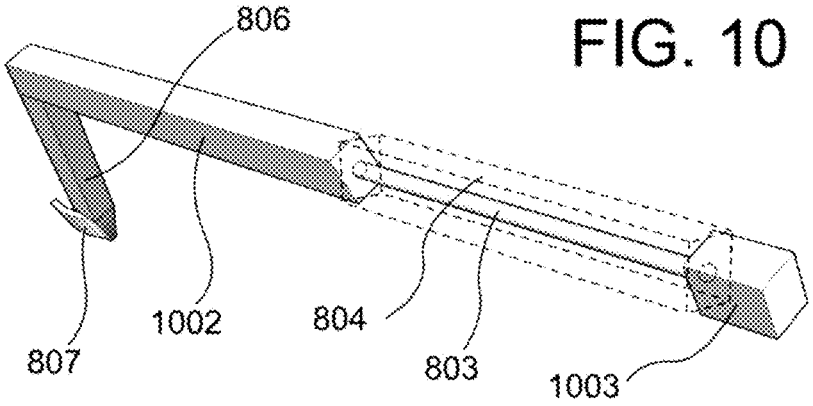
FIG. 10 is a perspective view of an alternative embodiment of the shooting apparatus slightly rotated.

(64) FIG. 10 shows a perspective view of an alternative embodiment of the shooting apparatus. A rotary member's handle 1002 made of wood is attached to the rotary member's shaft 803. The rotary member's shaft 803 goes through the support member's handle 804 and is attached to a rotary member's wooden block 1003 at the base. The rotary member's handle 1002 is connected to a propeller member 806 which is attached to the paddle member 807. The propeller member is elongated and angled away from the rotary member's shaft. The swapped arrangement of the rotary member's handle 1002 and support member's handle 804 is used similarly to the shooting apparatus of FIG. 8. However, to accommodate for different natures of right-handed or left-handed users who may stand on one side or the other of the playing surface platform of FIG. 12. The wooden block 1003 holds the support member's handle 804 in place, allowing it to rotate.

Figure 11:
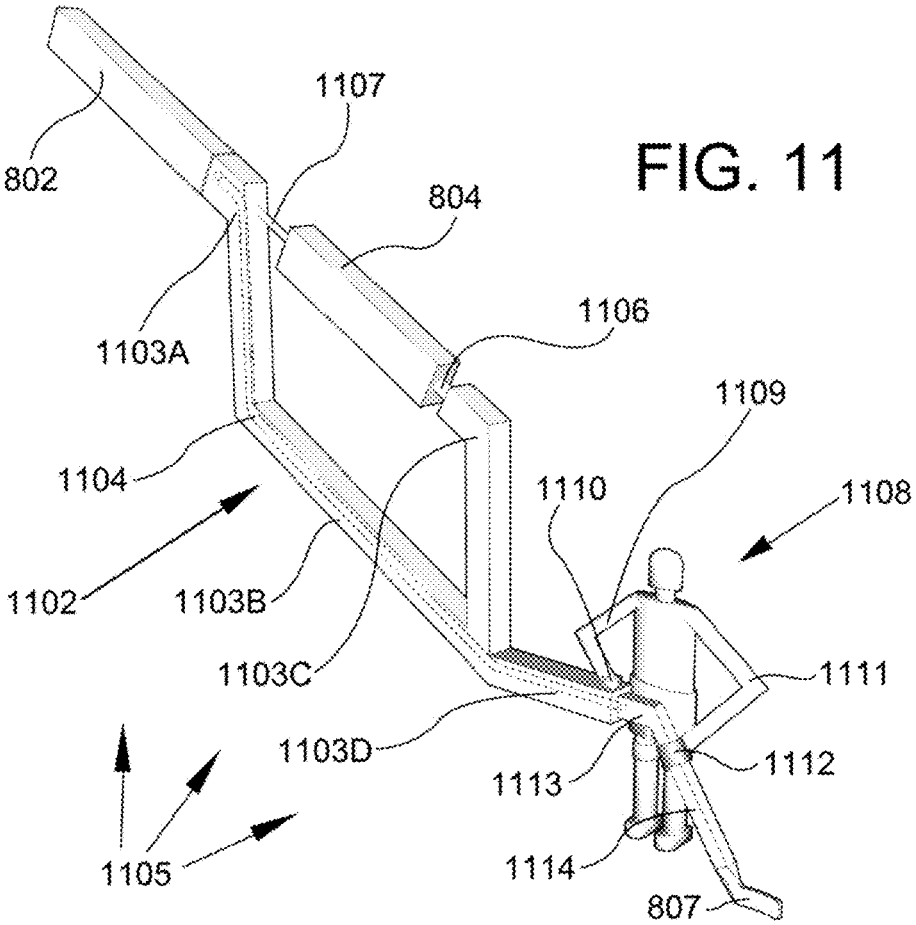
FIG. 11 is a perspective view of another alternative embodiment of the shooting apparatus.

(65) FIG. 11 shows a perspective view of another alternative embodiment of the shooting apparatus. A structural support member 1102 is composed of an elongated rear tube 1103A, a middle tube 1103B, a front tube 1103C, and a bottom tube 1103D in which a rotary member's flexible metal shaft 1104 is embedded. The rotary member's flexible shaft is made of a long metal rod fastened to a rotary member's handle 802. The rotary member 1105 is also composed of a rotary member's junction block 1113 similar to the rotary member's junction block 805 of FIG. 8; it is however merged with the propeller member 1114. The rotary member's flexible shaft is also fastened to the rotary member's junction block. The propeller member 1114 is elongated and angled away from the rotary member's junction block. The structural support member 1102 include also a separate support member's handle 804 attached, a ball-jointed stick 1106, and an elastic 1107. The ball jointed stick has a conventional ball-joint which is inserted to the support member's front tube 1103C and the stick is connected to the support member's handle 804. The support member's rear tube 1103A and the support member's handle 804 has an elastic 1107 attached in between. A small toy FIG. 1108 composed of a left arm 1109 made of a flexible material and contains a right hand 1110 made of plastic attached to the support member's bottom tube 1103D. The right arm 1111 is made of a flexible material with a left hand 1112 made of plastic attached to the propeller member 1114. In operation, the slight rotation of the rotary member's handle 802 allows to animate the toy FIG. 1108 which has members that are representative of an athlete. During a rotation of the rotary member 1105, the left toy hand 1112, and left toy arm 1113 may swing along with the propeller member 1114 as the right hand 1110 remains attached to the support member's bottom tube 1103D. An elastic 1107 and a ball jointed stick 1106 are used to allow the structural support member 1102 to loosen and pivot on multiple axes in addition to support the rotation of the rotary member 1105 with its structural support member 1102. The elastic 1107 allows restraining movements of the ball-jointed support member's handle 804. The rotary member's flexible shaft 1104 allows the rotary member's handle 802 and support member's handle 804 to be held and angled in diagonal position while remaining functional similarly as the preferred embodiment of FIG. 3.

(66) Although in these embodiments referring to FIGS. 8 and 10, the support member's handle 804 can move in rotation around the rotary member's shaft 803, in certain embodiments, it may also slide along a rotary member's single or multiple axes.

(67) Although in these embodiments referring to FIGS. 8, 10 and 11, the support member's handle 804 of the shooting apparatuses consist of a single handle of rectangular shape made of wood, in certain embodiments, various shapes such as cylindrical, elliptical, triangular, or a customized shape for the fingers are also conceivable. Also, other materials such as plastic, metal, or fiberglass may be used.

(68) Although in these embodiments referring to FIGS. 8, 10 and 11 the support member's handle 804 is located next to the rotary member's handle 802 and 1002, in certain embodiments, it may also be attached at different locations around its support member such as on the side or below.

(69) Although in these embodiments referring to FIGS. 8, 10 and 11 the rotary member's shafts 803 are made using a metal rod, in certain embodiments, other materials may be used as well such as plastics or woods. Additionally, shapes other than the metal rod may be used to attain a similar rotary effect of the rotary members such as a triangular or pentagonal rod in order to rotate the propeller member 806 or 1114.

(70) Although in this alternative embodiment referring to FIG. 11 the rotary member's flexible shaft 1104 made of a metal rod is used to allow the rotary member's handle 802 and support member's handle 804 to be angled in diagonal, in certain embodiments, it may also be made of another flexible material such as plastic and allow the paddle member 807 to be controlled at a different situation such as curling inside a distorted support member to reach diverse positions.

(71) Although in these embodiments referring to FIGS. 8 and 11 the rotary member's shafts 803 or 1104 have a rotary member's handle 802 attached in close proximity, in certain embodiments, a rotary member's handle may also be located on top, on the side, or at a different angle from the rotary member. In certain other embodiments, a rotary member may also be shaped to serve both as a merged shaft and handle

(72) Although in these embodiments referring to FIGS. 8 and 11 the rotary member's shafts 803 or 1104 have a rotary member's handle 802 consisting of a single handle of rectangular shape made of wood, in certain embodiments, various shapes such as cylindrical, elliptical, triangular, or a customized shape for the fingers are also conceivable. Also, other materials such as plastic, metal, or fiberglass may be used.

(73) Although in these embodiments referring to FIGS. 8, 10 and 11 the rotary members are composed of multiple parts such as handles 802 or 1002, junction block 805 or 1113 or wooden block 1003, and shaft 803 or 1104, in certain embodiments, it is possible for a rotary member to be composed of additional members to connect in different orders such as mounting to a game table with a mechanical structure to suspend a rotary member's handle.

(74) Although in these embodiments referring to FIGS. 8, 10 and 11 the rotary members are composed of multiple parts such as handles 802 or 1002, junction block 805 or 1113 or wooden block 1003, and shaft 803 or 1104, in certain embodiments, it is possible for a rotary member to be composed of additional members to fasten or merge to the propeller member.

(75) Although in these embodiments referring to FIGS. 8, 10 and 11 the rotary members are composed of multiple parts such as handles 802 or 1002, junction block 805 or 1113 or wooden block 1003, and shaft 803 or 1104, in certain embodiments, it is possible for a rotary member to be directly fastened or merged to the propeller member.

(76) Although in these embodiments referring to FIGS. 8 and 11 the rotary member's shaft 803 or 1104 is fastened to the rotary member's junction block 805 or 1113, in certain embodiments, it is possible for a rotary member's shaft to fasten or merged to the propeller member.

(77) Although in this embodiment referring to FIG. 8 the support member's handle 804 allows the rotary member's shaft 803 to rotate on a single axis, in certain embodiments, it is also possible for a rotary member to rotate on multiple axes through a modified support member.

(78) Although in this embodiment referring to FIG. 8 a rotary member's shaft 803 is internal to the support member's handle 804, in certain embodiments, a rotary member's shaft may be external instead; in which case, it could rotate on top, on the side, or below the support member. Also, it may be shaped to wrap and revolve around the support member externally such as a cylindrical shaped enclosure.

(79) Although in these embodiments referring to FIGS. 8 and 10 a rotary member's shaft 803 has a propeller member 806 attached, in certain embodiments, a rotary member may also be shaped to serve both as a merged rotary member and propeller member.

(80) Although in these embodiments referring to FIGS. 8, 10 and 11 a propeller member 806 or 1114 is composed of a single member, in certain embodiments, it is possible for a propeller member to be composed of multiple members such as an extra propeller members or connectors for other members. Furthermore, multiple propeller members may be angled and distorted.

(81) Although in these embodiments referring to FIGS. 8, 10 and 11 a propeller member 806 or 1114 is shaped as a squared tube made of aluminum, in certain embodiments it may be distorted or of different shapes such as triangular or cylindrical, and made of different materials such as plastics or woods.

(82) Although in these embodiments referring to FIGS. 8, 10 and 11 a propeller member 806 or 1114 is shaped as a squared tube, in certain embodiments it may be of shaped, arranged, or composed of one or a plurality of parts representative of different limbs or members of a figure such as a face, an athlete, a doll figure, a living entity, or a robot figure. Such part may also be partly two-dimensional using thin materials such as printed graphics or embroidery.

(83) Although in these embodiments referring to FIGS. 8, 10 and 11 a propeller member 806 or 1114 has a paddle member 807 attached, in certain embodiments, a propeller member may also be shaped to serve both as a merged propeller member and a paddle member.

(84) Although in these embodiments referring to FIGS. 8, 10 and 11 a paddle member 807 is shaped as a small scale hockey blade, in certain embodiments, the paddle member can be comprised of one or a plurality of parts of different shapes forming an element to represent a part such as an ice hockey blade, a floorball hockey blade, a field hockey blade, a mini hockey blade, distorted hockey blade, or other types of paddle intended for shooting.

(85) Although in this alternative embodiment referring to FIG. 11 a toy FIG. 1108 is mounted to the support member's bottom tube 1103D and propeller member 1114, in certain embodiments, a part may be shaped, arranged, or composed to represent a living entity or a doll figure which may be mounted to a different arrangement of members of the shooting apparatus such as the rotary member and the support member. Moreover, in certain other embodiments, a part shaped, arranged, or composed to represent a living entity or a doll figure may also be used as a support member adapted for gripping by the hand or the fingers. A part shaped, arranged, or composed to represent a living entity or a doll figure may also be composed of fewer or flat parts.

(86) Although in this embodiment the shields of the playing surface platform referring to FIG. 12 is set at a table level, in certain embodiments, a shield may be set at different surface heights such as an inferior table level or a ground level while accommodating the use of the hand-operated apparatus of FIG. 1 and the shooting apparatus of FIG. 8.

(87) Although in this embodiment referring to FIG. 12, the playing surface 1210 is flat, in certain embodiments, a playing surface may also be uneven, misshaped, or bumpy.

(88) Although in this embodiment referring to FIG. 12, the transparent shields 1206, 1207 and 1208 are made of nylon netting, plastics, and metal, in certain embodiments, a shield may be made of different materials arranged differently on the playing surface. A shield may also be made of different colors, shapes, and be composed of a plurality of members.

(89) Although in this embodiment referring to FIGS. 12 and 13, the playing surface 1210 allow the use of the apparatuses at an opening 1301 between two nettings 1307 and 1308, and through an opening of a shield 1207, in certain embodiments, a playing surface may also allow apparatuses to operate below, over, or through a shield with a different arrangement such as a single or a plurality of door openings, window openings, circular openings, or a large open area above or below a shield. An opening of a shield may also be composed of other materials such as fabrics or vinyl. A shield may allow only one player to operate a hand-operated apparatus or it may be conceived to allow more than two players to operate a hand-operated apparatus.

(90) Although in this embodiment referring to FIG. 12, the playing surface 1210 is composed of magnets to repulse with the hand-operated apparatus, in certain embodiments, a playing surface may also be composed of other ways or arrangements to approach a slippery surface such as the use of electromagnetism, blower fans, oils, or ice. A playing surface may also be adapted without a repulsion effect.

(91) Although in this embodiment referring to FIG. 12 the goals 1204 and 1205 are framed by a tube extended outside of the playing surface 1210, in certain embodiments, a goal may consist of an opening or embedded items in the playing surface or suspended frame outside of the playing surface. It may also comprise of targets similar to bowling pins or moving objects of different shapes.

(92) Although in this embodiment a small conventional puck, wrapped with miniature nylon loop fasteners, is used, in certain embodiments, different objects may be used for the same purpose of being propelled towards a target, a goal or a hand-operated apparatus. Objects such as a small ball bearing puck, a marble puck, a ball or other shapes such as triangular or hexagonal may also be conceivable.

Although the present invention has been shown in the drawings and fully described above with particularity and detail in connection with what is presently deemed described as the preferred embodiments, it is to be understood that the embodiments are merely illustrative of the principles and application of the present invention.

According to the present invention, certain alternative embodiments of the hand-operated apparatus and shooting apparatus may be of different sizes and adapted to different scales. It may also be adapted to different games or physical activities. The use of the shooting apparatus and that of the hand-operated apparatus are complementary but are not restricted to be used together within the playing surface platform of FIG. 12. These two apparatuses can be used either complementarily or separately to provide physical freedom of handling with comfort and precision on diverse surfaces and heights. Certain embodiments may also be used on the floor.

According to the present invention, certain embodiments of the hand-operated apparatus used as a finger-operated apparatus may be used without the goaltending method.

According to the present invention, certain embodiments of the hand-operated apparatus used as a finger-operated apparatus may be used as a doll or a puppet to simulate movements such as poses for a play or a display of poses.

According to the present invention, certain embodiments of the hand-operated apparatus used as a finger-operated apparatus may also be used with the goaltending method to defend a goal or a target without elongated members from finger holders.

According to the present invention, certain embodiments of the hand-operated apparatus used as a finger-operated apparatus may be used with the goaltending method to defend a goal or a target without bending or pivoting caused by elongated members from finger holders.

According to the present invention, certain alternative embodiments of the hand-operated apparatus may be composed of different misshaped equipment of its own kind and be provided as a new type of activity such as defending a goal or target from balls or pucks thrown from other apparatuses such as toy guns or catapults where another type of entity or robotic shaped hand-apparatus is involved.

According to the present invention, certain alternative embodiments of the hand-operated apparatus may be composed without one or a plurality of the secondary parts of the preferred embodiment such as the hook-and-loop fastener 705, the fan 202, the stick 604, the arm equipments 602 and 603 or the pad equipments 401L and 401R.

According to the present invention, certain alternative embodiments of the hand-operated apparatus may be composed of a glove which can be adapted to represent a pose of a living entity, a doll figure, or a robot.

According to the present invention, certain alternative embodiments of the hand-operated apparatus may be composed of finger holders located behind, below or above a hand-operated apparatus. Such finger holders would require support members which may be composed of components connected to a finger holder such as a glove or straps with stiff elongated members. For instance, elongated support members or a mechanical structure may allow finger holders to control elongated members from a different source.

According to the present invention, certain embodiments of the shooting apparatus may be used without a support member or a support member's handle and may be arranged for one single hand to hold the rotary member's shaft for rotation of the propeller member. For instance, a shooting apparatus may be shaped as a distorted "Z" letter.

According to the present invention, certain other embodiments of the shooting apparatus may be used without a support member or a support member's handle and may be shaped, arranged, or composed of one or a plurality of parts representative of different limbs or members of a figure such as a face, an athlete, a doll figure, a living entity, or a robot figure. Such part may also be partly two-dimensional using thin materials such as printed graphics or embroidery.

According to the present invention, certain embodiments of the shooting apparatus may consist of removable, interchangeable, or added members of different shapes and lengths with additional components such as a rotary member's handle or support member's handle above or below the support member or flexible member for insertion of fingers. It may also be of smaller size for fewer fingers to grip on or of larger size for further reach on the playing surface.

According to the present invention, certain alternative embodiments of the shooting apparatus may consist of members with different shapes and lengths such as distorted, rounded, or curved forms of rotary members, support members, or propeller members.

According to the present invention, referring to FIG. 8 the support member 804 is shaped to serve as a handle 804. Subsequently, in this alternative embodiment referring to FIG. 11 the support member 804 is composed of a support member's handle 804 ball-jointed to a structural support member 1103A, 1103B, 1103C, and 1103D. In certain embodiments, a support member's handle and a structural support may be jointed or ball-jointed, connected with a rigid or flexible material, or may be merged to both serve as a single part support member.

According to the present invention, certain alternative embodiments of the shooting apparatus may be composed of fewer parts such as a stick which includes multiple members merged as one piece.

According to the present invention, certain embodiments of the shooting apparatus may be composed of a part representative of an athlete, a doll figure, a robot or any living entity which may add interactions with the dynamic activity such as animating, deflecting, or blocking the ball or puck.

According to the present invention, certain alternative embodiments of the playing surface platform may vary in scales and dimensions to accommodate different apparatuses in accordance to different numbers of players or goals around the playing surface.

According to the present invention, magnetism may be controlled in either the playing surface platform or the hand-operated apparatus for the user to sense a simulation of a goalie getting tired by progressively reducing and reversing the polarity from repulsion to attraction as the game advances. Polarity may also be reversed by flipping the magnets to allow the user to feel a spontaneous retention from the playing surface in order to create a sensation of body heaviness or to delay the movements of the hand-operated apparatus. This addition may be prepared to add difficulty and handicap to the user and may be embedded to a game operation. Mechanical components or electrical components and electromagnetism such as electromagnetic coils may be used to control the polarity. Strength of the polarity may be increased or reduced at different spots on the playing surface. More than a dozen magnets per extremity and may be embedded to the playing surface.

According to the present invention, certain alternative embodiments of the playing surface platform may be composed of fewer parts such as a shield which includes multiple shields merged as one piece.

It is therefore to be understood that numerous modifications, additions, and alterations may be made to include variations in form of functions, manners of operation, assembly, and other arrangements may be devised without departing from the spirit and scope of the present invention as defined in the appended claims so as to encompass all such modifications and equivalents. Hence, these and other variations and combinations of the features described above may be utilized without departing from the present invention as defined by the claims.

What is claimed as the invention is:

1. A shooting apparatus with a rotary member and a support member for propelling an object from a surface towards a target or a goal with two hands of a user, the shooting apparatus comprising:

a. said rotary member with means for gripping by one of said two hands, b. said support member for gripping by the remaining hand of said two hands, c. said rotary member is adapted with means for rotating by said hand and wrist, d. a propeller member elongated from said rotary member, e. said propeller member is angled away from said rotary member, f. said propeller member adapted for rotating along with said rotary member, g. a paddle member expanded from said propeller member, h. said paddle member adapted for sliding on a surface with downwards, upward, forward, backward and sideway movements of the user's hands gripping to said rotary member and said support member, i. said paddle member is adapted for sliding on a surface with forward and backward movements of the user's hand gripping to said rotary member by rotating said rotary member, j. said paddle member is adapted for propelling and optionally elevating said object precisely from said surface towards said target or said goal located on a surface level or higher, k. a rotation of said rotary member is adapted to slide said paddle on said surface in a circular motion, with a front facade of said paddle moving in its front direction away from said surface, l. a rotation of said rotary member is adapted to slide said paddle on said surface in a circular motion, with a back facade of said paddle moving in its back direction away from said surface, m. said sliding allows said user to raise said rotary member to handle a ball or a puck similarly to a sport of hockey, moveable on multiple axes to slide and turn said paddle in multiple directions to allow said paddle of said propeller member to simulate a hockey player's action movements such as stick handling, n. said paddle member is adapted to be representative of a hockey blade, o. said support member is adapted to support said rotation of said rotary member, p. said support member is adapted with means for gripping by said hand of said two hands, while said remaining hand of said two hands is gripping to said rotary member elongated from said support member.

2. The shooting apparatus as recited in claim 1, wherein at least one of said members is composed of a flexible material.

3. The shooting apparatus as recited in claim 1, wherein said rotary member comprises of at least one long flexible material passing through a structural support member.

4. The shooting apparatus as recited in claim 1, wherein at least one of said members is adapted to be representative of a part of a living entity or a robot.

5. The shooting apparatus as recited in claim 1, wherein at least one of said members is fastened to at least one part representative of an action figure.

* * * * *